US011426009B2

(12) United States Patent
Clemmer et al.

(10) Patent No.: US 11,426,009 B2
(45) Date of Patent: Aug. 30, 2022

(54) BASSINET

(71) Applicant: Wonderland Switzerland AG, Steinhausen (CH)

(72) Inventors: Lance J. Clemmer, Mohnton, PA (US); Jonathan K. Mountz, Birdsboro, PA (US); Jonathan M. Pacella, Gap, PA (US)

(73) Assignee: Wonderland Switzerland AG, Steinhausen (CH)

( * ) Notice: Subject to any disclaimer, the term of this patent is extended or adjusted under 35 U.S.C. 154(b) by 0 days.

(21) Appl. No.: 16/908,767

(22) Filed: Jun. 23, 2020

(65) Prior Publication Data

US 2020/0405073 A1 Dec. 31, 2020

Related U.S. Application Data

(60) Provisional application No. 62/873,358, filed on Jul. 12, 2019, provisional application No. 62/867,479, filed on Jun. 27, 2019.

(51) Int. Cl.

| | |
|---|---|
| ***A47D 9/00*** | (2006.01) |
| ***A47D 7/01*** | (2006.01) |
| ***A47D 7/04*** | (2006.01) |

(52) U.S. Cl.

CPC ..... *A47D 9/00* (2013.01); *A47D 7/01* (2013.01); *A47D 7/04* (2013.01)

(58) Field of Classification Search

CPC ..... A47D 9/00; A47D 7/04

See application file for complete search history.

(56) References Cited

U.S. PATENT DOCUMENTS

| | | | | |
|---|---|---|---|---|
| 871,692 | A | 11/1907 | Gray | |
| 2010/0263121 | A1 | 10/2010 | Arnold, IV | |
| 2017/0196373 | A1* | 7/2017 | Sclare | A47D 13/06 |

FOREIGN PATENT DOCUMENTS

| | | | | |
|---|---|---|---|---|
| CN | 103479133 | A * | 1/2014 | A47D 5/00 |
| CN | 106263817 | A * | 1/2017 | A47C 9/005 |
| CN | 207532206 | U | 6/2018 | |
| CN | 207561646 | U | 7/2018 | |
| CN | 208030773 | U * | 11/2018 | A47D 9/00 |
| CN | 208403884 | U * | 1/2019 | |
| CN | 208403884 | U | 1/2019 | |
| CN | 209003360 | U | 6/2019 | |
| DE | 10 2015 220 035 | A1 | 4/2016 | |
| EP | 3626132 | A1 * | 3/2020 | A61B 5/0002 |

* cited by examiner

*Primary Examiner* — Peter M. Cuomo
*Assistant Examiner* — Adam C Ortiz
(74) *Attorney, Agent, or Firm* — Winston Hsu

(57) ABSTRACT

The invention may telescopically connect the first support member and the second support member together or pivotally connect the first support member to the pivot hub on the bassinet, such that the bassinet can be adjusted to various heights for a given situation. Furthermore, the bassinet may be adjusted to a desired height and then placed in a play yard without requiring additional components. Since the bassinet of the invention can be used alone and can also be used with the play yard, the bassinet of the invention is more flexible in use than a conventional bassinet.

8 Claims, 21 Drawing Sheets

BASSINET

CROSS REFERENCE TO RELATED APPLICATIONS

This application claims the benefit of U.S. Provisional Application No. 62/867,479, which was filed on Jun. 27, 2019, and is incorporated herein by reference and U.S. Provisional Application No. 62/873,358, which was filed on Jul. 12, 2019, and is incorporated herein by reference.

BACKGROUND OF THE INVENTION

1. Field of the Invention

The invention relates to a bassinet and, more particularly, to a bassinet capable of being adjusted to various heights for a given situation.

2. Description of the Prior Art

Bassinets are often rigid in their construction and lack the ability to be adjusted to various heights for a given situation. Caregivers desire a bassinet that is portable, can be used in a play yard, and can be used at bedside height. Bassinets that can achieve these features typically require a separate frame which the bassinet is placed on when used in bedside mode. The additional components, cost and complexity of such bassinets are undoubtedly a disadvantage to the caregiver.

SUMMARY OF THE INVENTION

The invention provides a bassinet capable of being adjusted to various heights for a given situation, so as to solve the aforesaid problems.

According to an embodiment of the invention, a bassinet comprises a rail structure, a first support member, a second support member and a latch mechanism. The first support member is connected to the rail structure. The second support member is telescopically connected to the first support member. The latch mechanism is configured to lock or unlock the first support member and the second support member. When the latch mechanism locks the first support member and the second support member, a height of the bassinet is fixed. When the latch mechanism unlocks the first support member and the second support member, the first support member and the second support member are able to slide with respect to each other to adjust the height of the bassinet.

According to another embodiment of the invention, a bassinet comprises a rail structure, a sleeping surface, a pivot hub, and a first support member. The sleeping surface is located below the rail structure. The pivot hub is selectively located on a perimeter of one of the rail structure and the sleeping surface. The first support member is pivotally connected to the pivot hub. The first support member is able to rotate to adjust a height of the bassinet.

According to another embodiment of the invention, a bassinet comprises a rail structure, a first support member and a second support member. The first support member is in an inverted U-shape connected to the rail structure and has a handle above the rail structure. The second support member is telescopically connected to the first support member. The first support member and the second support member are able to slide with respect to each other to adjust a height of the bassinet.

As mentioned in the above, in an embodiment, the invention may telescopically connect the first support member and the second support member together and utilize the latch mechanism to lock or unlock the first support member and the second support member, so as to adjust the height of the bassinet by sliding the first support member and the second support member with respect to each other. In another embodiment, the invention may pivotally connect the first support member to the pivot hub on the bassinet, so as to adjust the height of the bassinet by rotating the first support member. Accordingly, the bassinet of the invention can be adjusted to various heights for a given situation. For example, the height of the bassinet may be shortened to be close to the ground or be lengthened to achieve bedside height. Furthermore, the bassinet may be adjusted to a desired height and then placed in a play yard without requiring additional components. Since the bassinet of the invention can be used alone and can also be used with the play yard, the bassinet of the invention is more flexible in use than a conventional bassinet.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
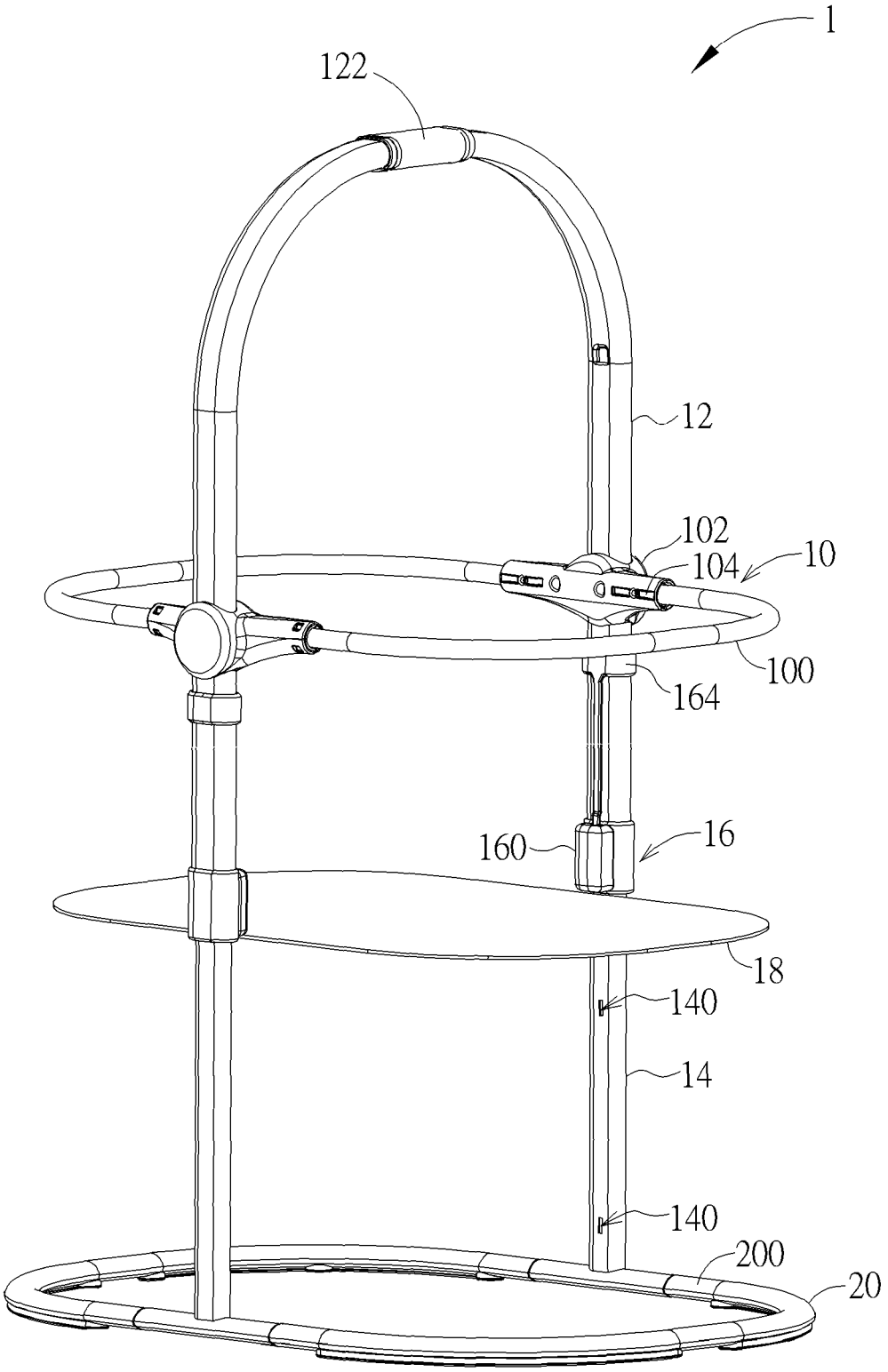
FIG. 1 is a perspective view illustrating a bassinet according to an embodiment of the invention.
Figure 2:
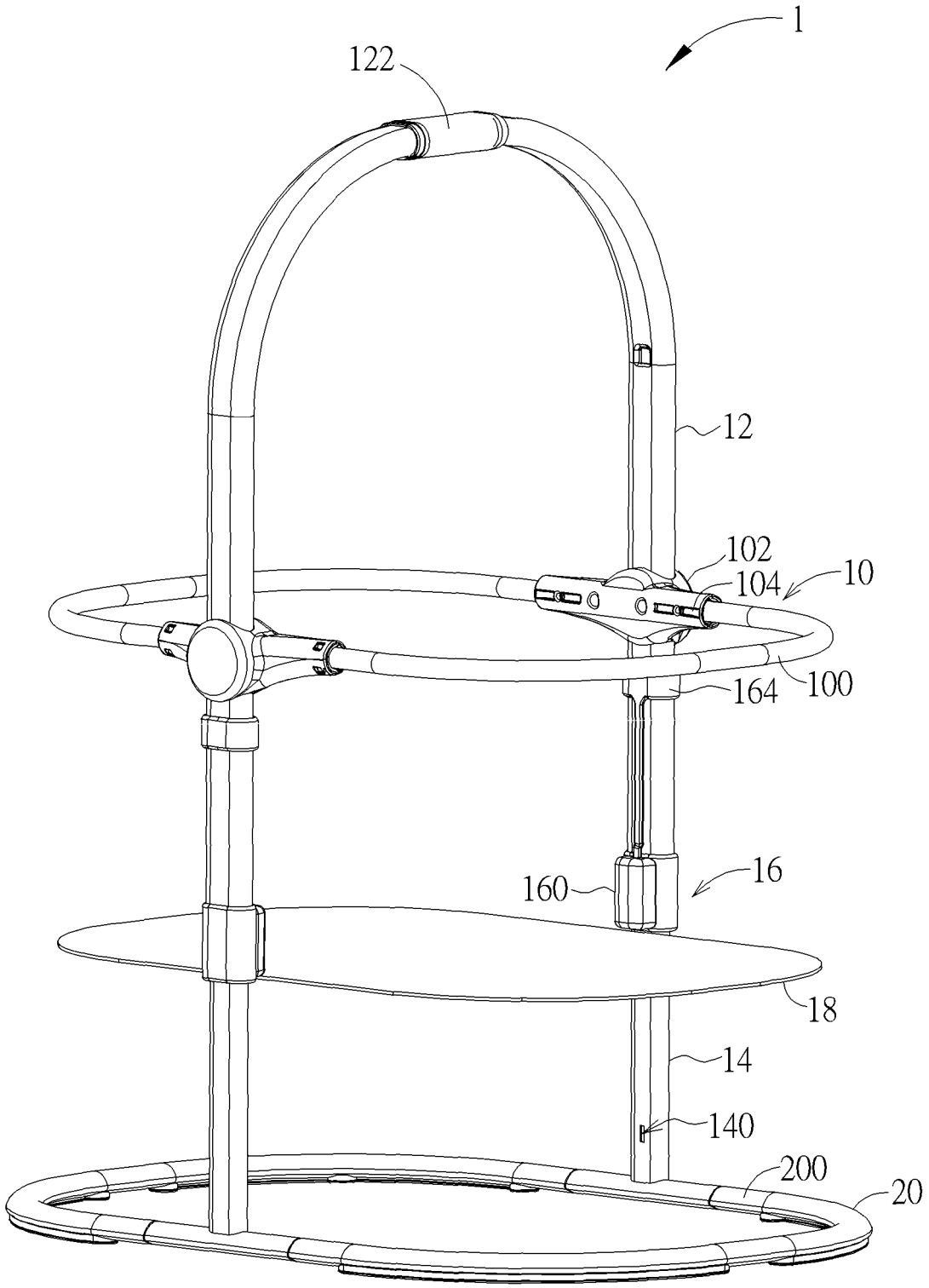
FIG. 2 is a perspective view illustrating the bassinet shown in FIG. 1 being adjusted to another height.
Figure 3:
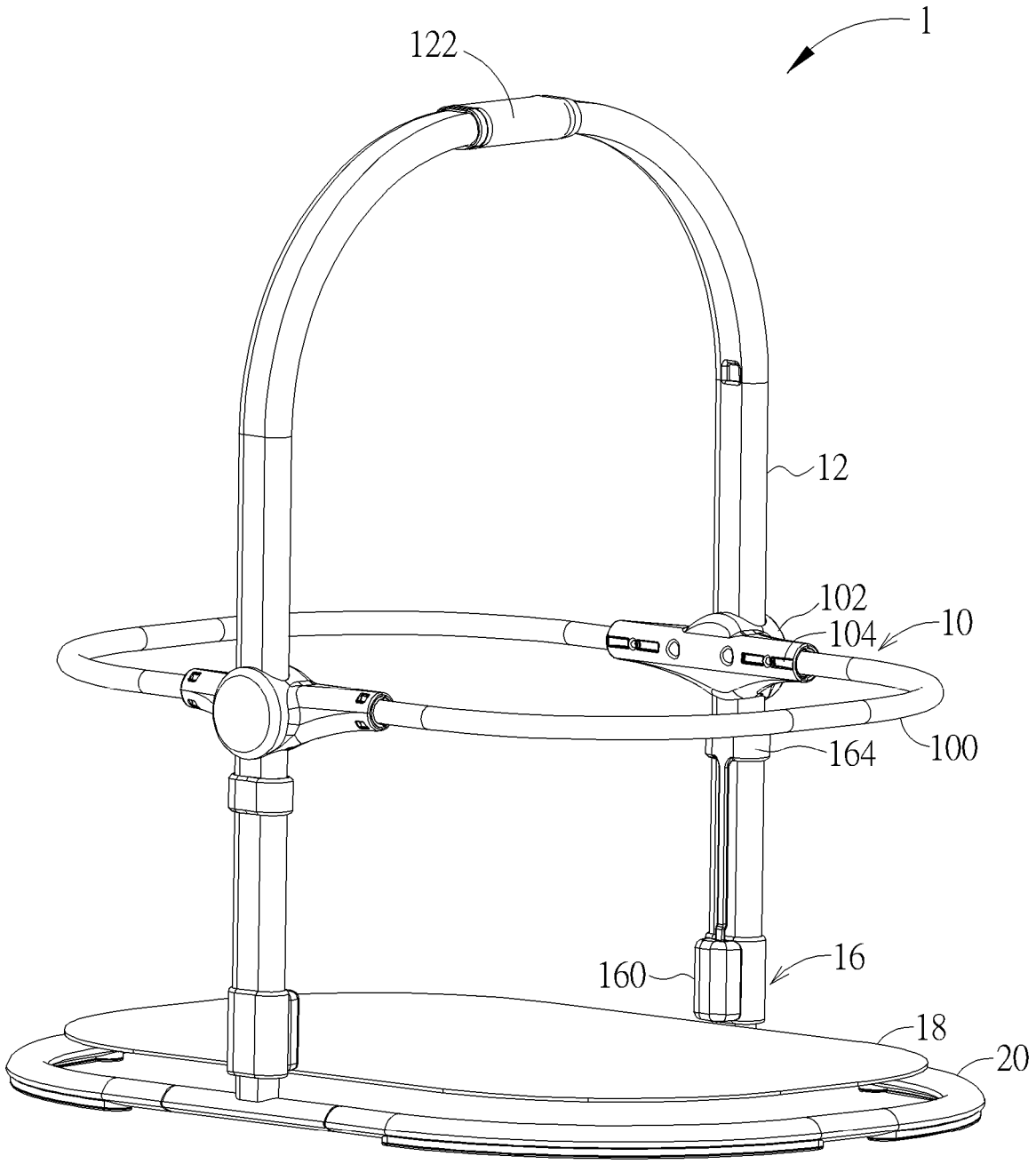
FIG. 3 is a perspective view illustrating the bassinet shown in FIG. 2 being adjusted to another height.
Figure 4:
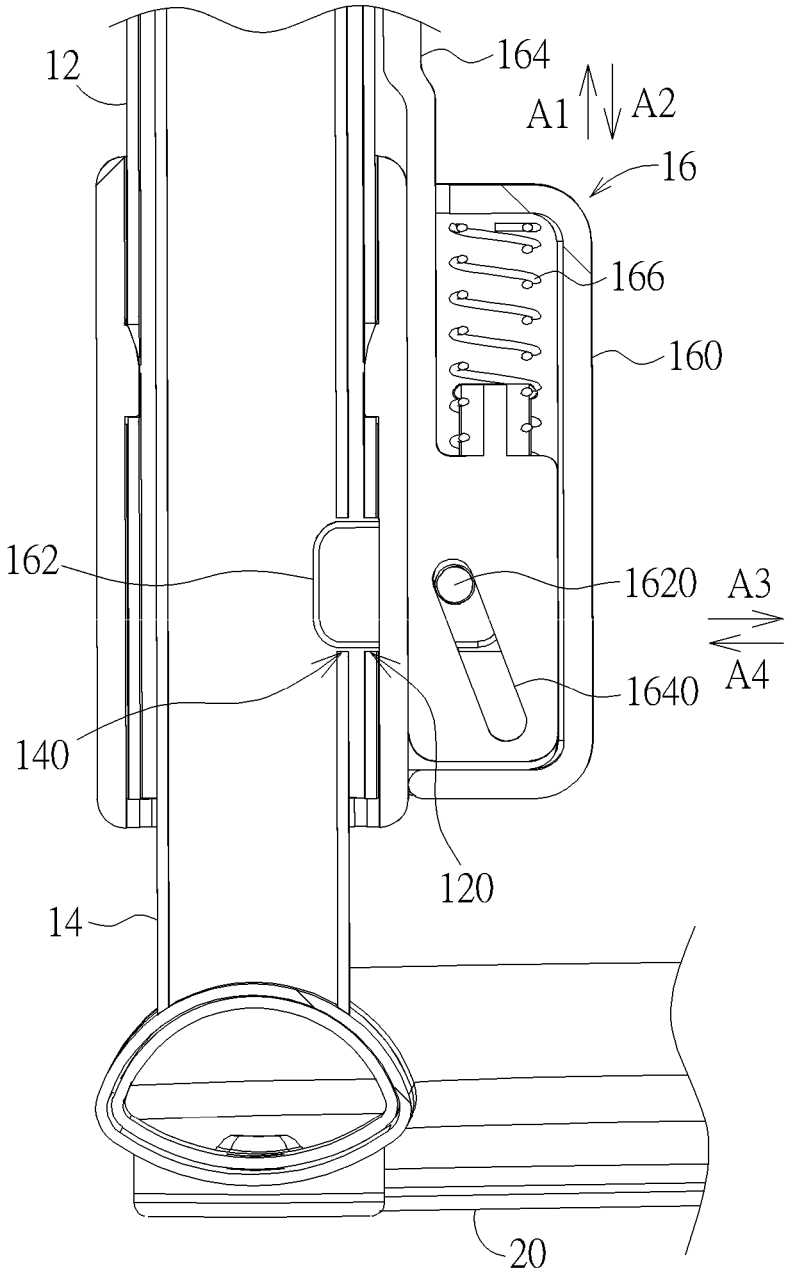
FIG. 4 is a sectional view illustrating the latch mechanism shown in FIG. 3.

Referring to FIGS. 1 to 4, FIG. 1 is a perspective view illustrating a bassinet 1 according to an embodiment of the invention, FIG. 2 is a perspective view illustrating the bassinet 1 shown in FIG. 1 being adjusted to another height, FIG. 3 is a perspective view illustrating the bassinet 1 shown in FIG. 2 being adjusted to another height, and FIG. 4 is a sectional view illustrating the latch mechanism 16 shown in FIG. 3.

As shown in FIGS. 1 to 3, the bassinet 1 comprises a rail structure 10, a first support member 12, a second support member 14, a latch mechanism 16, a sleeping surface 18 and a base 20. In practical applications, the bassinet 1 may be further equipped with a canopy, a softgoods clothing and/or other accessories. The sleeping surface 18 may be accommodated in the softgoods clothing attached to the rail structure 10.

In this embodiment, the rail structure 10 may comprise two U-shaped rails 100 and two rail sockets 102. The U-shaped rails 100 are inserted into the rail sockets 102 and attached with snap buttons 104 of the rail sockets 102. A user may press the snap buttons 104 to detach the U-shaped rails 100 from the rail sockets 102. The first support member 12 is connected to the rail structure 10. In this embodiment, the first support member 12 may be in an inverted U-shape and both ends of the first support member 12 are attached to the rail sockets 102. Accordingly, the first support member 12 may have a handle 122 above the rail structure 10 for a user to carry the bassinet 1. The latch mechanism 16 may be disposed on the bottom of the first support member 12. In this embodiment, the bassinet 1 may comprise two latch mechanisms 16 disposed on both bottoms of the first support member 12.

In this embodiment, the second support member 14 may comprise two vertical tubes connected to the base 20 with snap buttons 200. A user may press the snap buttons 200 to detach the second support member 14 from the base 20. The second support member 14 is telescopically connected to the first support member 12 and the latch mechanism 16 is configured to lock or unlock the first support member 12 and the second support member 14. When the latch mechanism 16 locks the first support member 12 and the second support member 14, a height of the bassinet 1 is fixed. When the latch mechanism 16 unlocks the first support member 12 and the second support member 14, the first support member 12 and the second support member 14 are able to slide with respect to each other to adjust the height of the bassinet 1. As shown in FIG. 1, the height of the bassinet 1 may be lengthened to achieve bedside height. As shown in FIG. 3, the height of the bassinet 1 may be shortened to be close to the ground. As shown in FIG. 2, the height of the bassinet 1 may be adjusted to an intermediate height between FIG. 1 and FIG. 3. Accordingly, the bassinet 1 of the invention can be adjusted to various heights for a given situation.

In this embodiment, the latch mechanism 16 may comprise a housing 160, a latch member 162, an operating member 164 and an elastic member 166, as shown in FIG. 4. The housing 160 is attached to the bottom of the first support member 12. The operating member 164 is movably disposed on the first support member 12 and one end of the operating member 164 is accommodated in the housing 160. The elastic member 166 is disposed in the housing 160, wherein opposite ends of the elastic member 166 abut against the operating member 164 and the housing 160.

The first support member 12 comprises a first slot 120 and the second support member 14 comprises a plurality of second slots 140. Each of the second slots 140 corresponds to one height shown in FIGS. 1 to 3. The latch member 162 is movably disposed in the housing 160. As shown in FIG. 4, the latch member 162 passes through the first slot 120 of the first support member 12 and engages with one of the second slots 140 of the second support member 14 so that the height of the bassinet 1 is fixed.

The operating member 164 has a guiding groove 1640 and the latch member 162 has a guiding portion 1620 disposed in the guiding groove 1640. In this embodiment, the guiding groove 1640 may be inclined with respect to a direction of movement of the operating member 164 indicated by arrows A1 and A2.

As shown in FIG. 4, when the operating member 164 is operated to move towards the direction of arrow A1, the guiding groove 1640 drives the guiding portion 1620 to move towards the direction of arrow A3 so that the latch member 162 disengages from the second slot 140 of the second support member 14 and the elastic member 166 is compressed by the operating member 164. At this time, the user can slide the first support member 12 with respect to the second support member 14 to adjust the sleeping surface 18 of the bassinet 1 to a desired height. When the desired height is reached, the first slot 120 is aligned with one of the second slots 140 and the operating member is released, the elastic member 166 forces the operating member 164 to move towards the direction of arrow A2, so as to return the latch member 162 into the second slot 140 towards the direction of arrow A4. Accordingly, the sleeping surface 18 of the bassinet 1 is fixed at the desired height.

Figure 5:
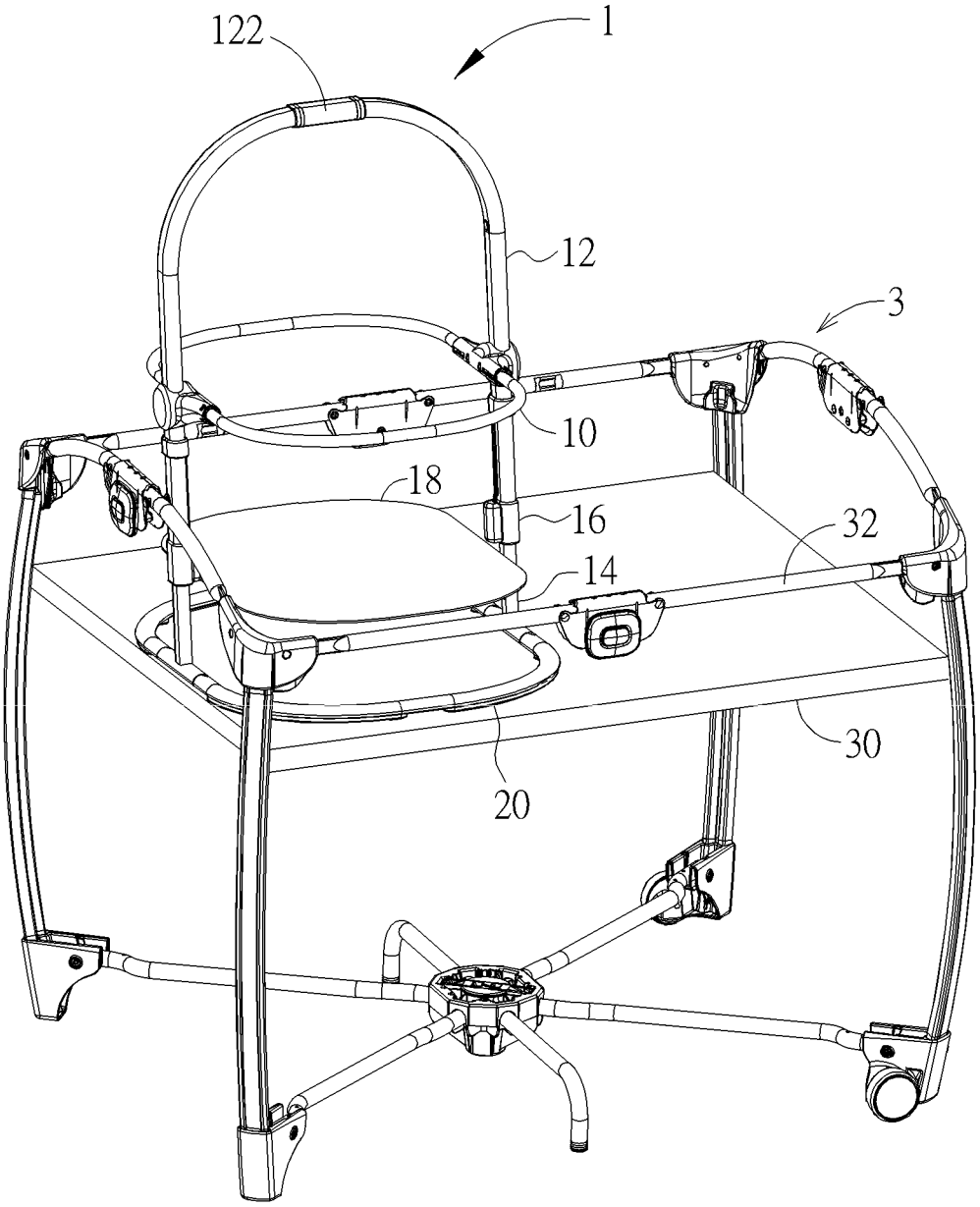
FIG. 5 is a perspective view illustrating the bassinet shown in FIG. 2 being placed in a play yard.

Referring to FIG. 5, FIG. 5 is a perspective view illustrating the bassinet 1 shown in FIG. 2 being placed in a play yard 3. As shown in FIG. 5, the bassinet 1 may be placed in a play yard 3. For example, the bassinet 1 may be adjusted to the desired height and placed on an elevated mattress 30 of the play yard 3, such that the sleeping surface 18 of the bassinet 1 may be flush with or higher than a top frame 32 of the play yard 3. The bassinet 1 placed on the mattress 30 of the play yard 3 can provide a higher position of use, such that a caregiver can easily monitor a baby or child sleeping in the bassinet 1. Since the bassinet 1 of the invention can be used alone and can also be used with the play yard 3, the bassinet 1 of the invention is more flexible in use than a conventional bassinet.

Figure 6:
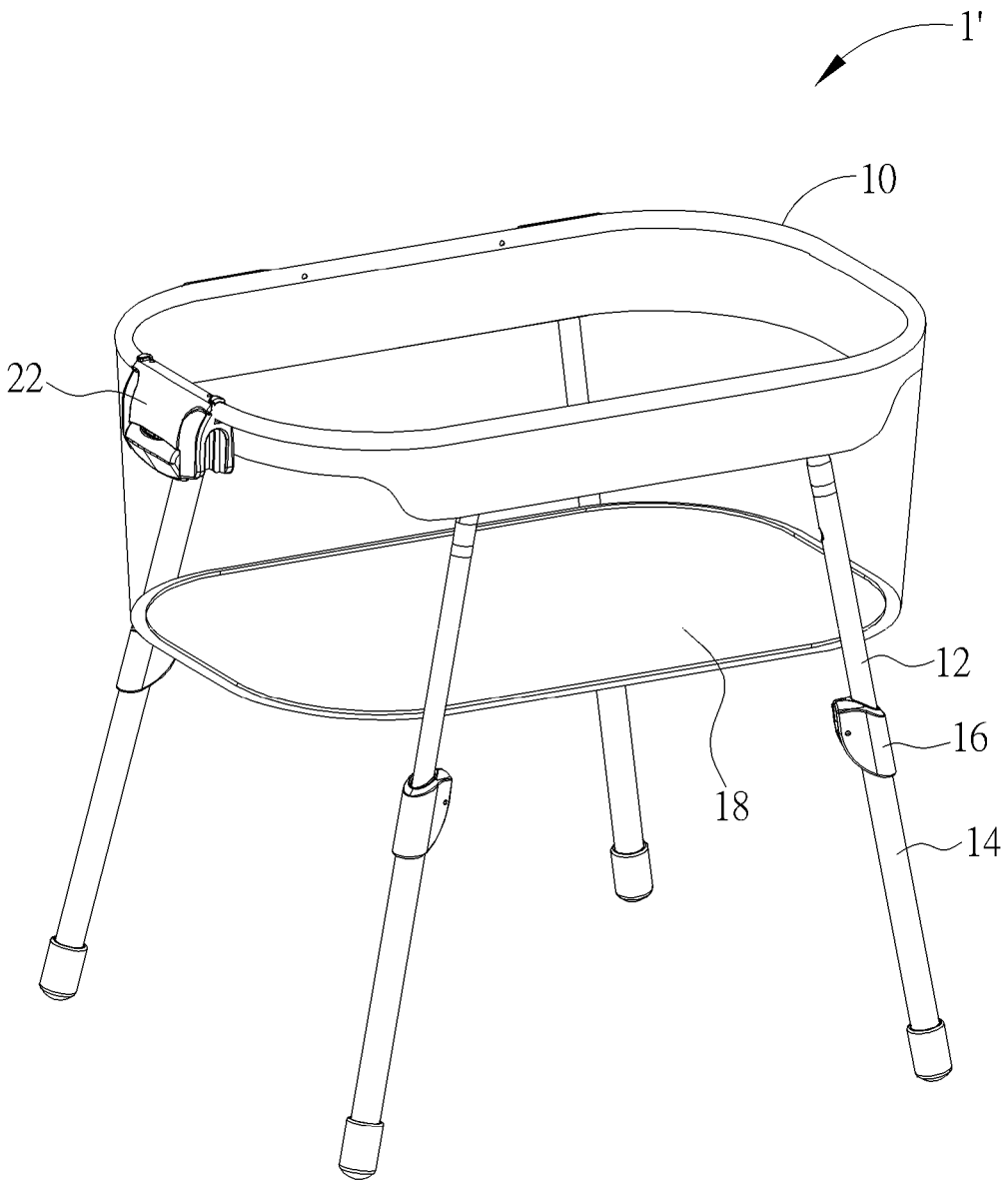
FIG. 6 is a perspective view illustrating a bassinet according to another embodiment of the invention.
Figure 7:
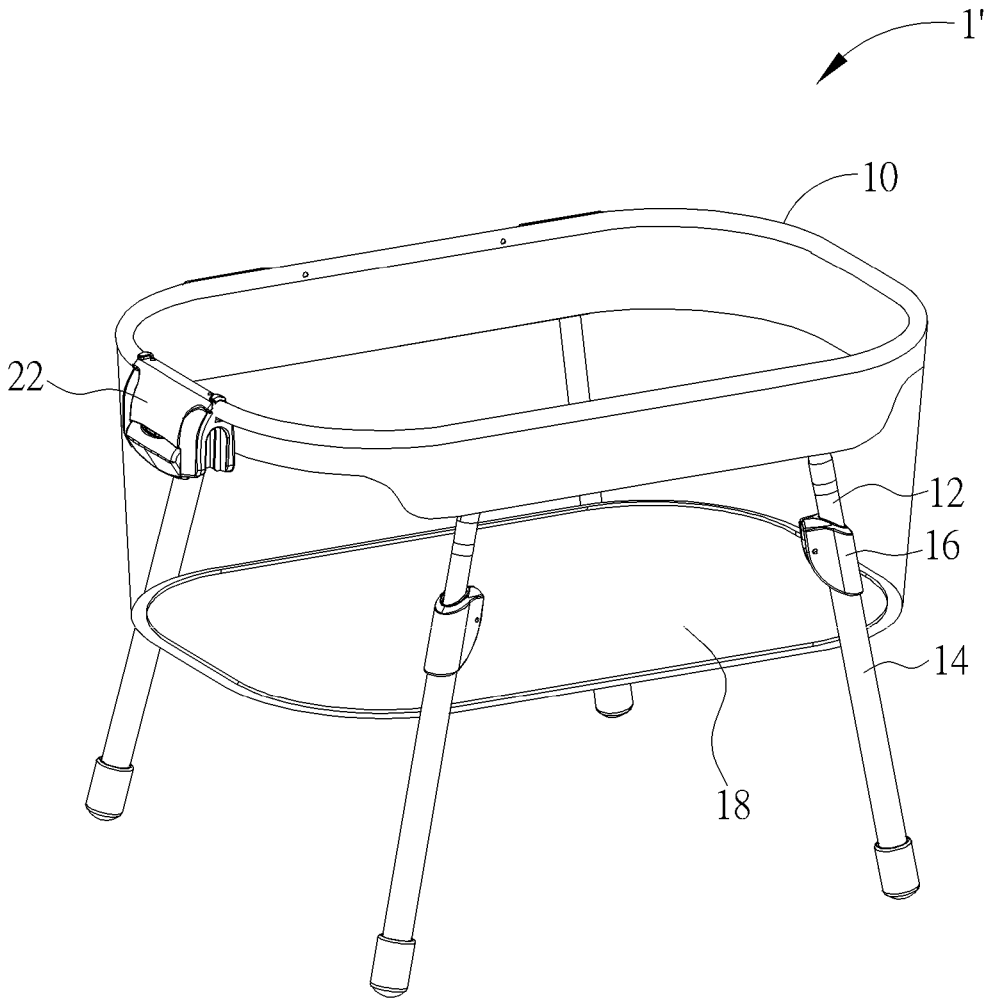
FIG. 7 is a perspective view illustrating the bassinet shown in FIG. 6 being adjusted to another height.
Figure 8:
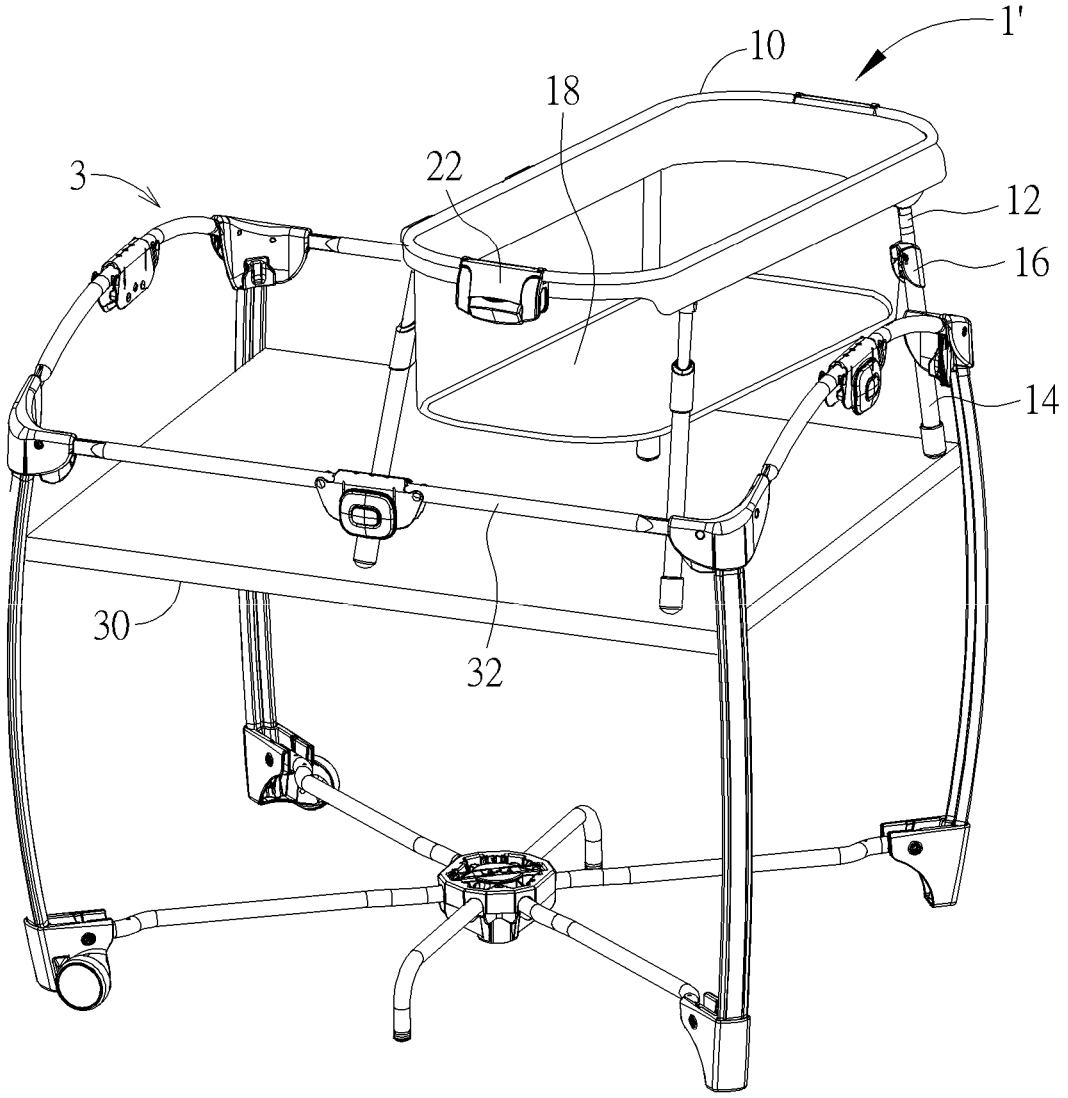
FIG. 8 is a perspective view illustrating the bassinet shown in FIG. 7 being placed in the play yard.
Figure 9:
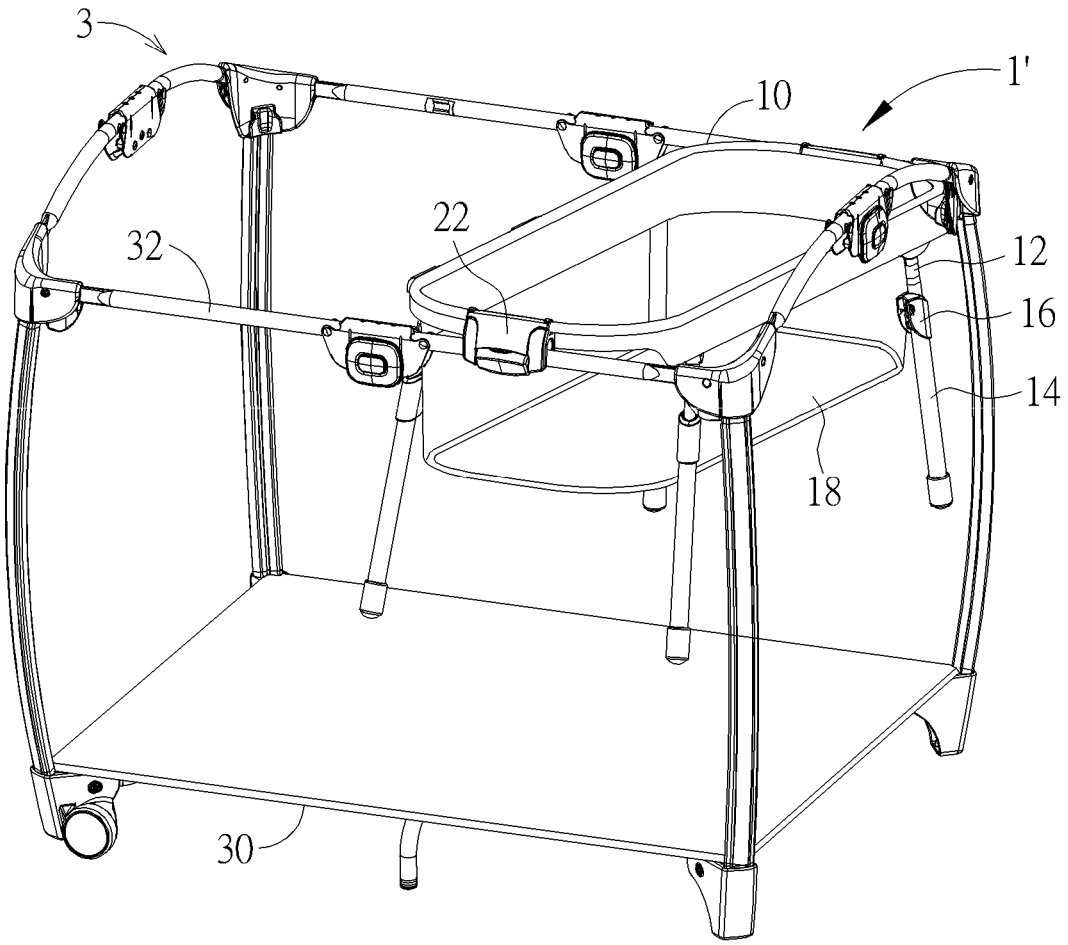
FIG. 9 is a perspective view illustrating the bassinet shown in FIG. 7 being hung on the top frame of the play yard.

Referring to FIGS. 6 to 9, FIG. 6 is a perspective view illustrating a bassinet 1' according to another embodiment of the invention, FIG. 7 is a perspective view illustrating the bassinet 1' shown in FIG. 6 being adjusted to another height, FIG. 8 is a perspective view illustrating the bassinet 1' shown in FIG. 7 being placed in the play yard 3, and FIG. 9 is a perspective view illustrating the bassinet 1' shown in FIG. 7 being hung on the top frame 32 of the play yard 3.

As shown in FIGS. 6 and 7, the first support member 12 of the bassinet 1' may comprise four upper tubes and the second support member 14 may comprise four lower tubes. In this embodiment, the second support member 14 is also telescopically connected to the first support member 12, but the latch mechanism 16 is disposed on the second support member 14. In this embodiment, the bassinet 1' may comprise four latch mechanisms 16 disposed on the tops of four lower tubes of the second support member 14. The latch mechanism 16 is configured to lock or unlock the first support member 12 and the second support member 14. It should be noted that the configuration and operation of the latch mechanism 16 have been mentioned in the above and those will not be depicted herein again. As shown in FIG. 6, the height of the bassinet 1' may be lengthened to achieve bedside height. As shown in FIG. 7, the height of the bassinet 1' may be shortened to be close to the ground. Accordingly, the bassinet 1' of the invention can be adjusted to various heights for a given situation.

As shown in FIG. 8, the bassinet 1' may be placed in the play yard 3. For example, the bassinet 1' may be adjusted to the desired height and placed on the elevated mattress 30 of the play yard 3, such that the sleeping surface 18 of the bassinet 1' may be flush with or higher than the top frame 32 of the play yard 3. The bassinet 1' placed on the mattress 30 of the play yard 3 can provide a higher position of use, such that a caregiver can easily monitor a baby or child sleeping in the bassinet 1'.

In this embodiment, the rail structure 10 of the bassinet 1' may comprise two hanging members 22 disposed on opposite sides. As shown in FIG. 9, the hanging members 22 are configured to hang the bassinet 1' on the top frame 32 of the play yard 3 to provide a lower position of use, such that the caregiver can easily put a baby or child into the bassinet 1' or take the baby or child out of the bassinet 1'. Since the bassinet 1' of the invention can be used alone and can also be used with the play yard 3, the bassinet 1' of the invention is more flexible in use than a conventional bassinet.

Figure 10:
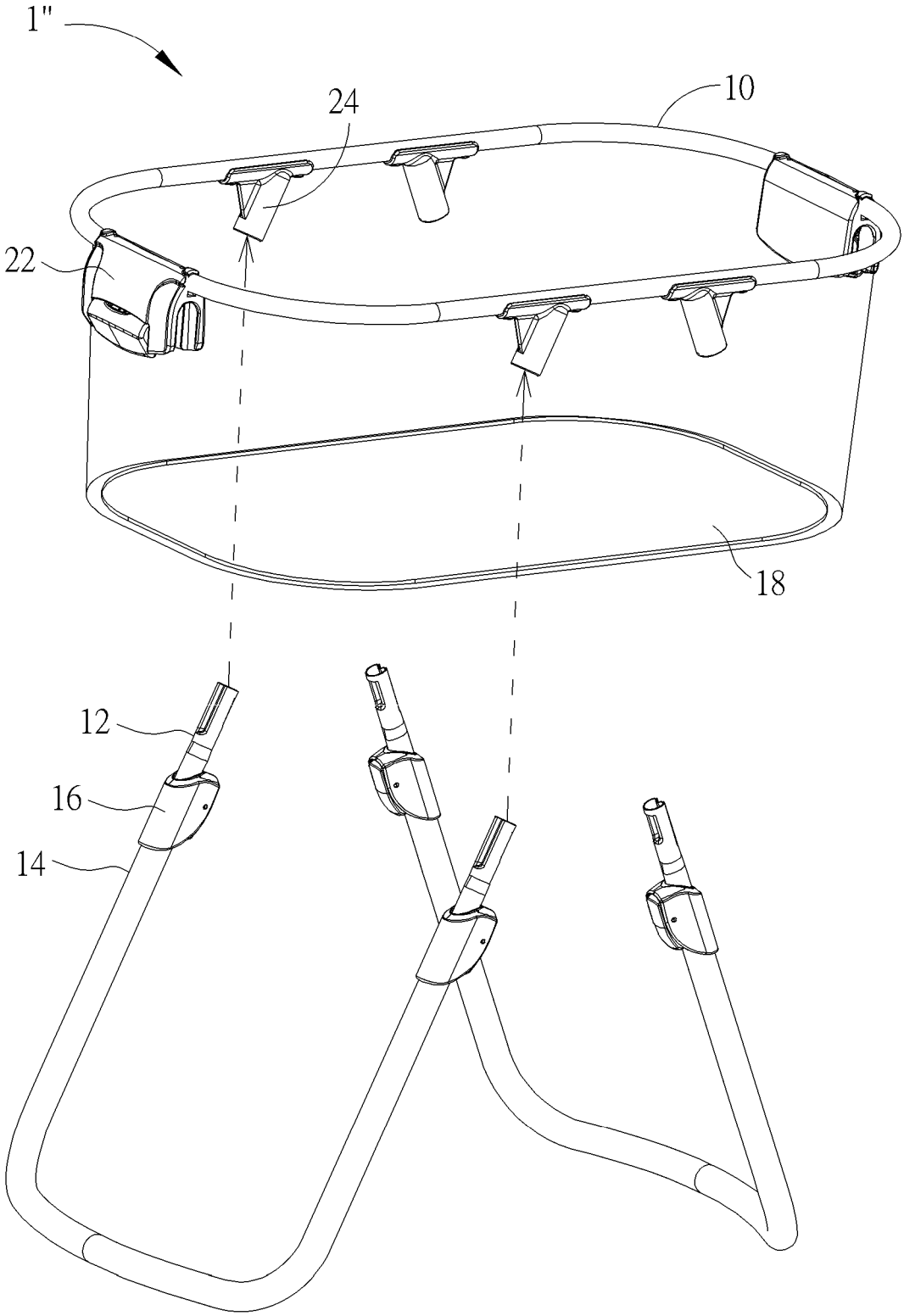
FIG. 10 is a perspective view illustrating a bassinet according to another embodiment of the invention.

Referring to FIG. 10, FIG. 10 is a perspective view illustrating a bassinet 1' according to another embodiment of the invention. The main difference between the bassinet 1" and the aforesaid bassinet 1' is that the rail structure 10 of the bassinet 1' further comprises a socket 24 and the first support member 12 of the bassinet 1" is detachably connected to the socket 24. Accordingly, the first support member 12 together with the second support member 14 can be removed from the bassinet 1". Furthermore, the second support member 14 of the bassinet 1" may comprise two U-shaped tubes instead of four individual tubes. Needless to say, the bassinet 1' can also be placed on the elevated mattress 30 of the play yard 3 shown in FIG. 8 to provide a higher position of use and the bassinet 1" can also be hung on the top frame 32 of the play yard 3 by the hanging members 22 to provide a lower position of use. Since the bassinet 1' of the invention can be used alone and can also be used with the play yard 3, the bassinet 1" of the invention is more flexible in use than a conventional bassinet.

Figure 11:
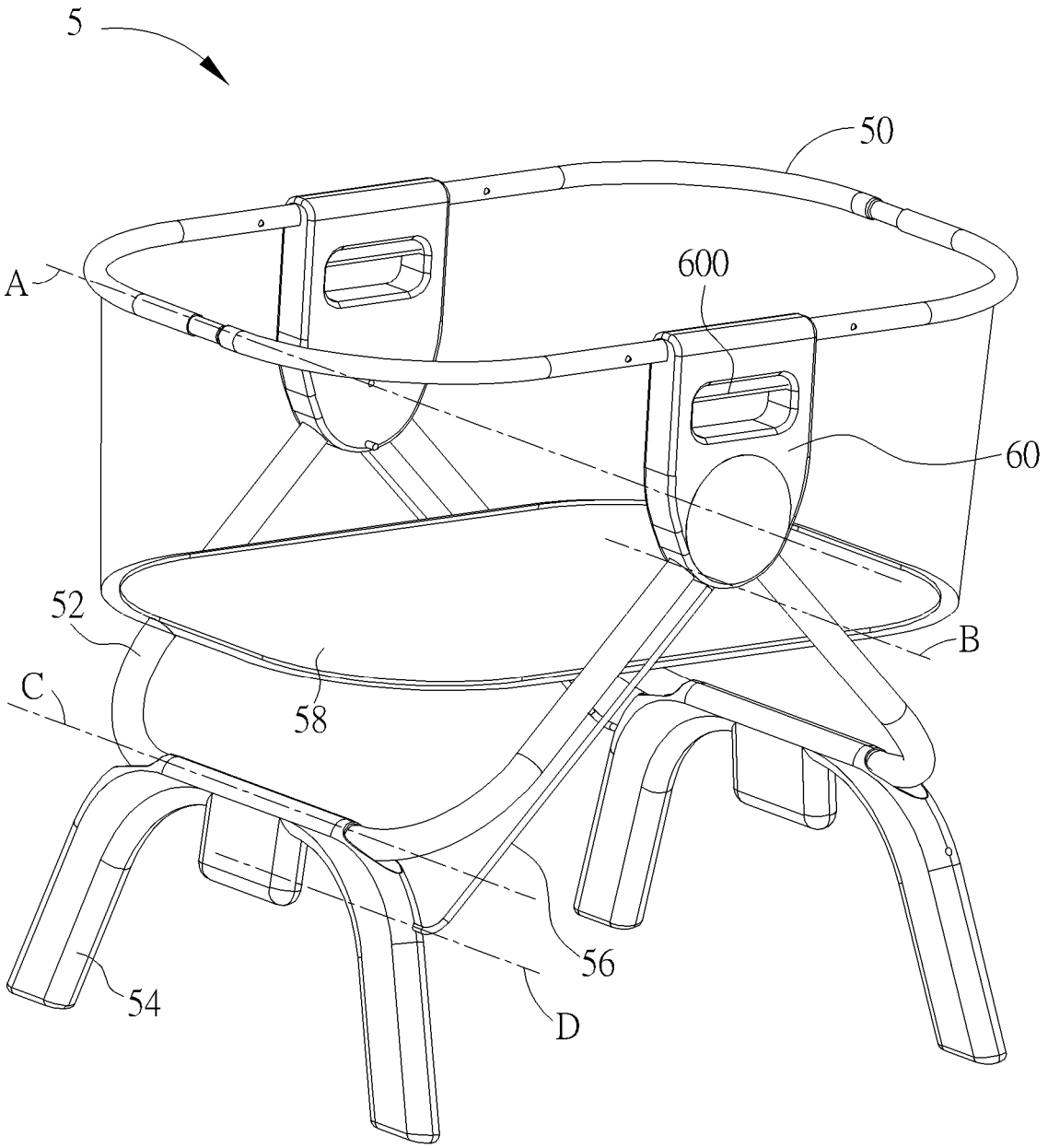
FIG. 11 is a perspective view illustrating a bassinet according to another embodiment of the invention.
Figure 12:
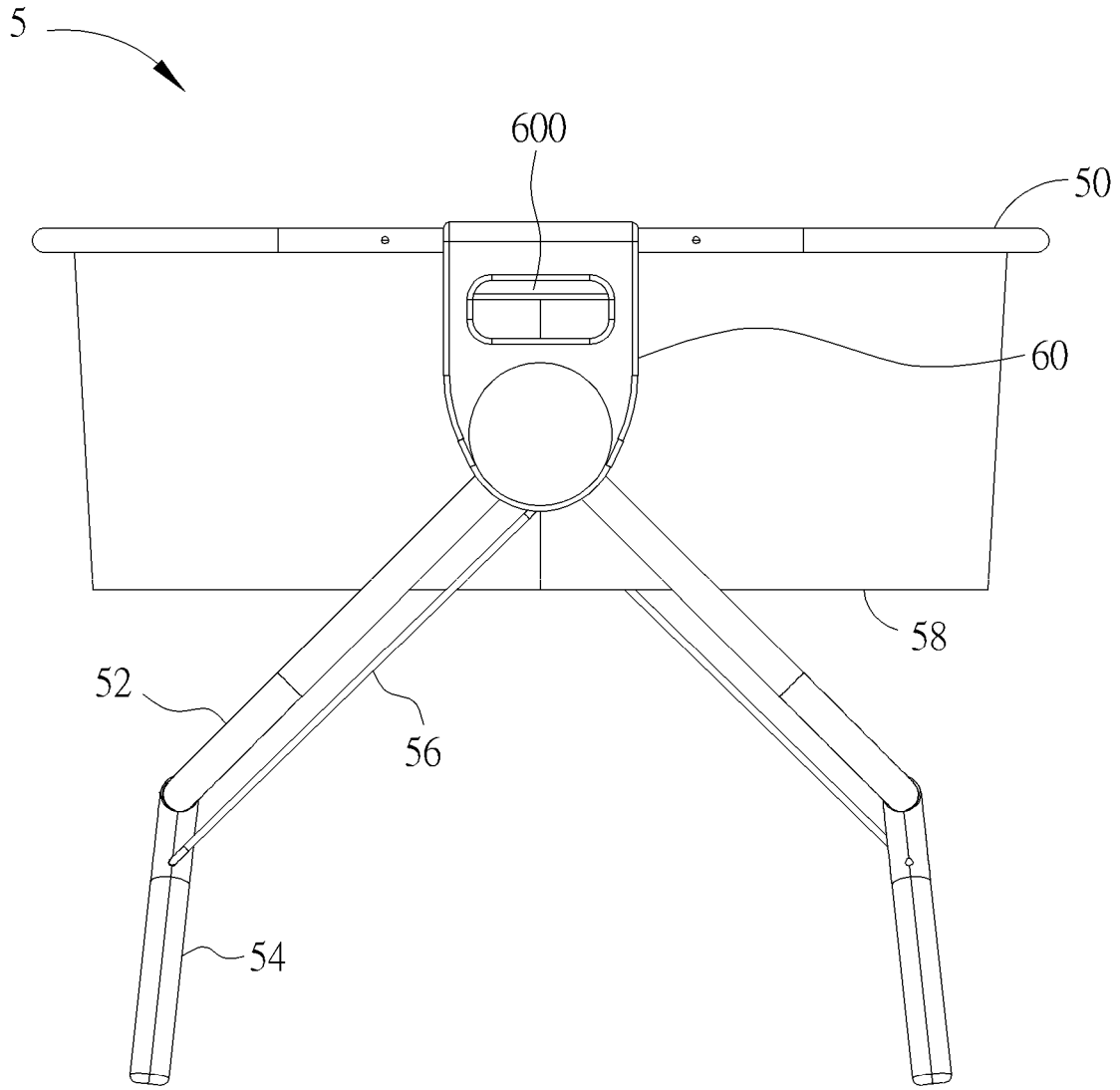
FIG. 12 is a side view illustrating the bassinet shown in FIG. 11.
Figure 13:
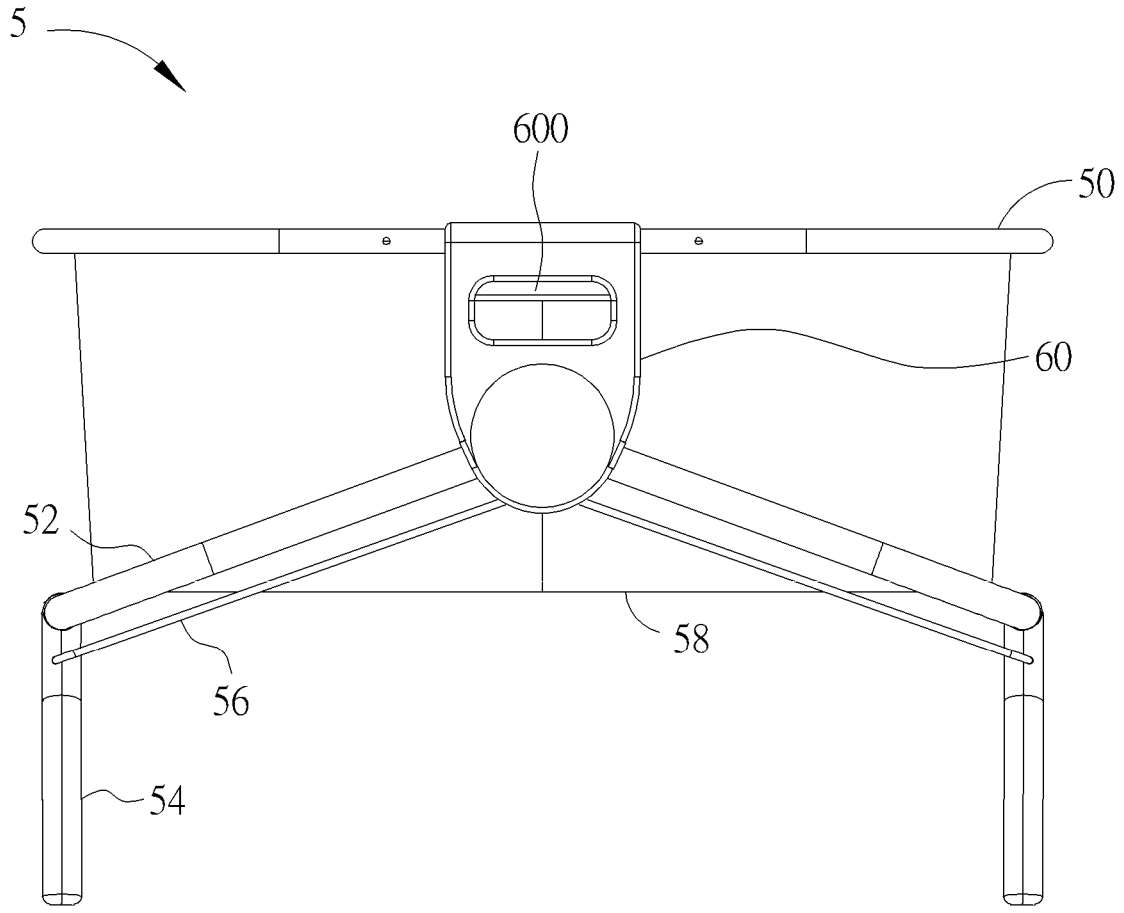
FIG. 13 is a side view illustrating the bassinet shown in FIG. 12 being adjusted to another height.
Figure 14:
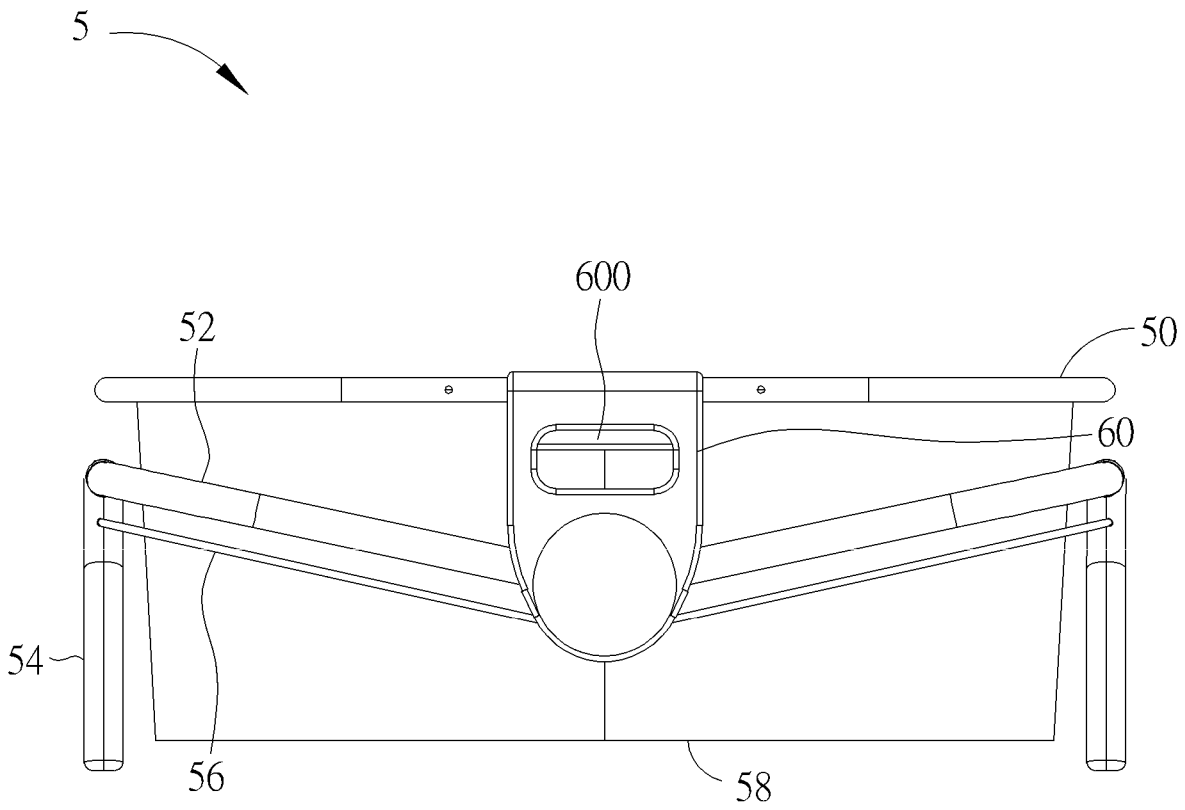
FIG. 14 is a side view illustrating the bassinet shown in FIG. 13 being adjusted to another height.

Referring to FIGS. 11 to 14, FIG. 11 is a perspective view illustrating a bassinet 5 according to another embodiment of the invention, FIG. 12 is a side view illustrating the bassinet 5 shown in FIG. 11, FIG. 13 is a side view illustrating the bassinet 5 shown in FIG. 12 being adjusted to another height, and FIG. 14 is a side view illustrating the bassinet 5 shown in FIG. 13 being adjusted to another height.

As shown in FIG. 11, the bassinet 5 comprises a rail structure 50, a first support member 52, a second support member 54, a link member 56, a sleeping surface 58 and a pivot hub 60. In practical applications, the bassinet 5 may be further equipped with a canopy, a softgoods clothing and/or other accessories. The sleeping surface 58 may be accommodated in the softgoods clothing attached to the rail structure 50. The sleeping surface 58 is located below the rail structure 50.

In this embodiment, the pivot hub 60 is located on a perimeter of the rail structure 50. As shown in FIG. 11, there are two pivot hubs 60 located on the perimeter of the rail structure 50 and opposite to each other. The first support member 52 is pivotally connected to the pivot hub 60, the second support member 54 is pivotally connected to the first support member 52, and the link member 56 is pivotally connected to the pivot hub 60 and the second support member 54. Furthermore, the pivot hub 60 may have an actuating member 600 configured to unlock the first support member 52. When the actuating member 600 is depressed, the first support member 52 is able to rotate to adjust a height of the bassinet 5. As shown in FIG. 12, the height of the bassinet 5 may be lengthened to achieve bedside height. As shown in FIG. 14, the height of the bassinet 5 may be shortened to be close to the ground. As shown in FIG. 13, the height of the bassinet 5 may be adjusted to an intermediate height between FIG. 12 and FIG. 14. Accordingly, the bassinet 5 of the invention can be adjusted to various heights for a given situation.

In this embodiment, the first support member 52 may comprise two U-shaped upper tubes and the second support member 54 may comprise two U-shaped lower legs. The upper end of the first support member 52 is pivotally connected to the pivot hub 60 via pivot axis A and can rotate when the actuating member 600 is depressed. The second support member 54 is pivotally connected to the lower end of the first support member 52 via pivot axis C. The link member 56 is pivotally connected to the pivot hub 60 via pivot axis B and pivotally connected to the second support member 54 via pivot axis D. Accordingly, the first support member 52, the second support member 54, the link member 56 and four pivot axes A-D create a four-bar linkage, such that the second support member 54 can be maintained in a vertical orientation by the four-bar linkage between the pivot hub 60, the first support member 52, the second support member 54 and the link member 56 while the first support member 52 rotates. Therefore, the second support member 54 can always support the bassinet 5 on a plane after rotating the first support member 52 to adjust the height of the bassinet 5.

Figure 15:
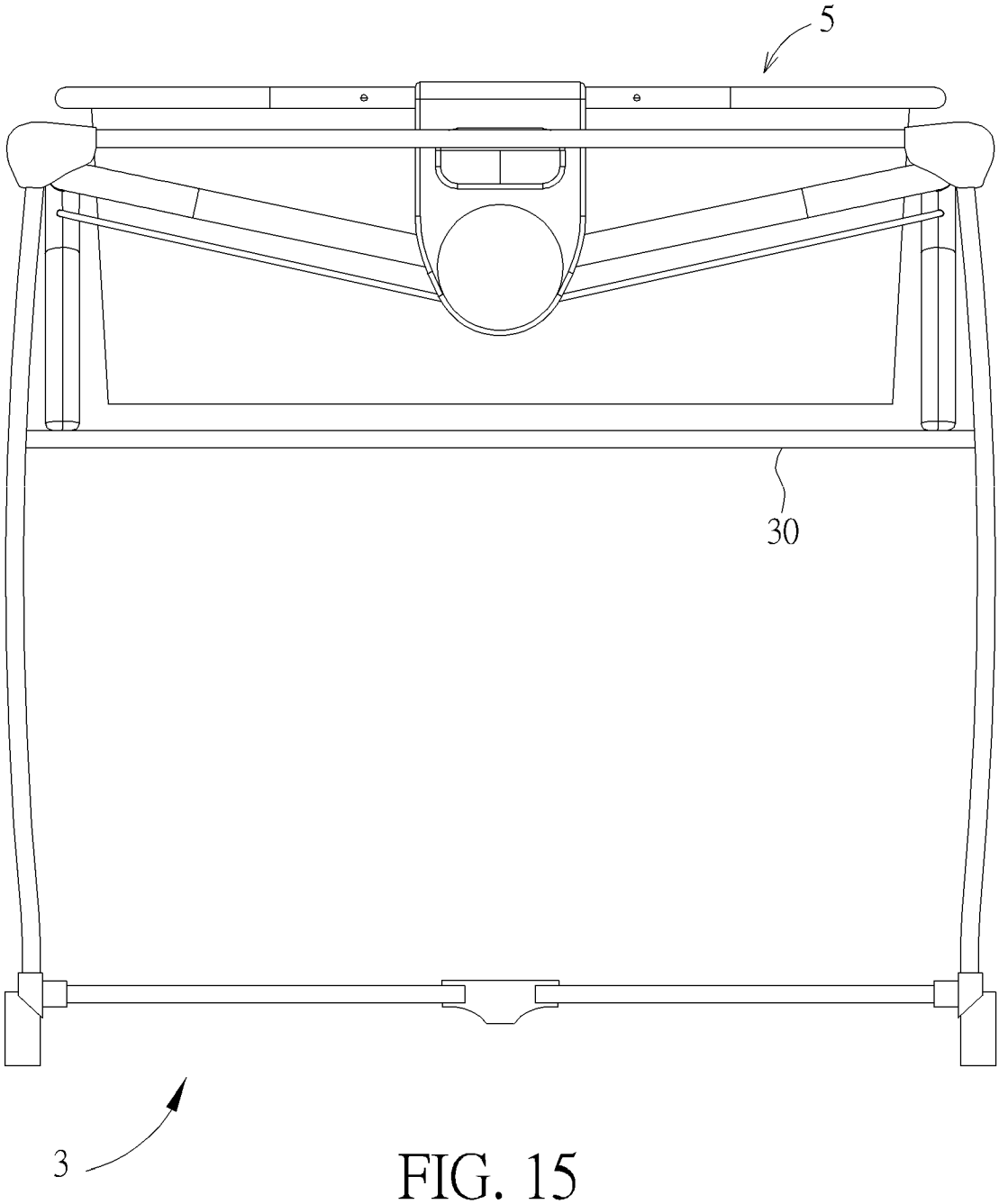
FIG. 15 is a side view illustrating the bassinet shown in FIG. 14 being placed in the play yard.

Referring to FIG. 15, FIG. 15 is a side view illustrating the bassinet 5 shown in FIG. 14 being placed in the play yard 3. As shown in FIG. 15, the bassinet 5 may be placed in the play yard 3. For example, the bassinet 5 may be adjusted to the desired height and placed on the elevated mattress 30 of the play yard 3. The bassinet 5 placed on the mattress 30 of the play yard 3 can provide a higher position of use, such that a caregiver can easily monitor a baby or child sleeping in the bassinet 5. Since the bassinet 5 of the invention can be used alone and can also be used with the play yard 3, the bassinet 5 of the invention is more flexible in use than a conventional bassinet.

Figure 16:
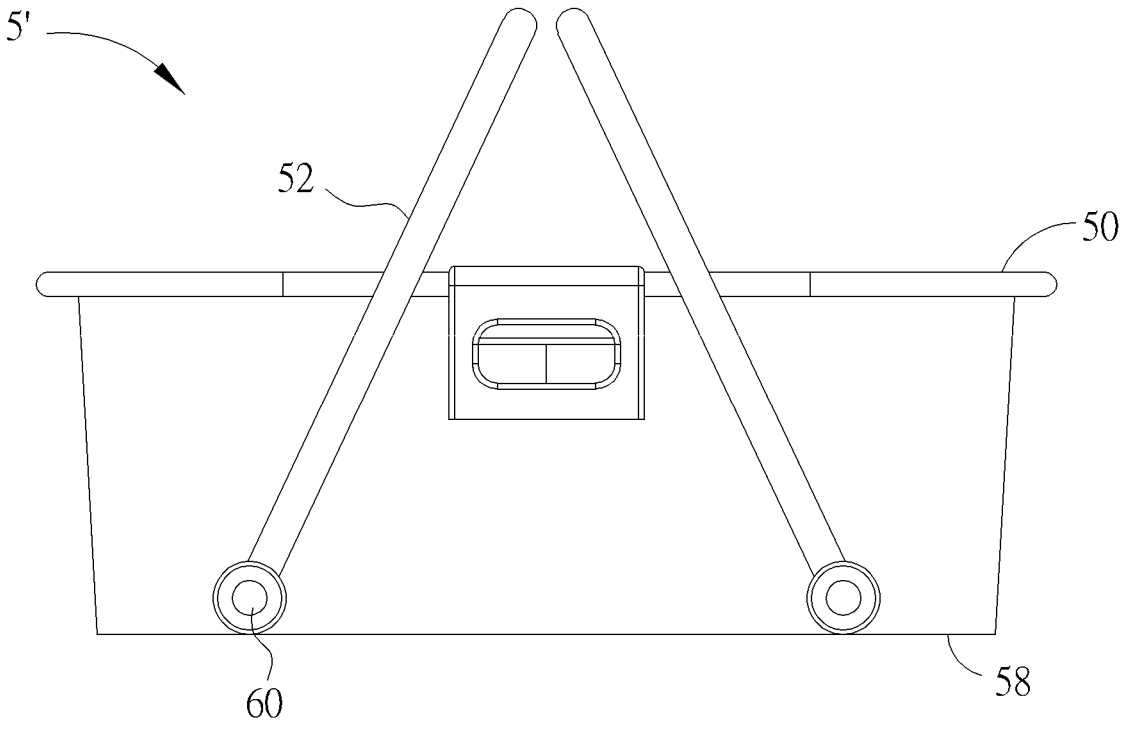
FIG. 16 is a side view illustrating a bassinet according to another embodiment of the invention.
Figure 17:
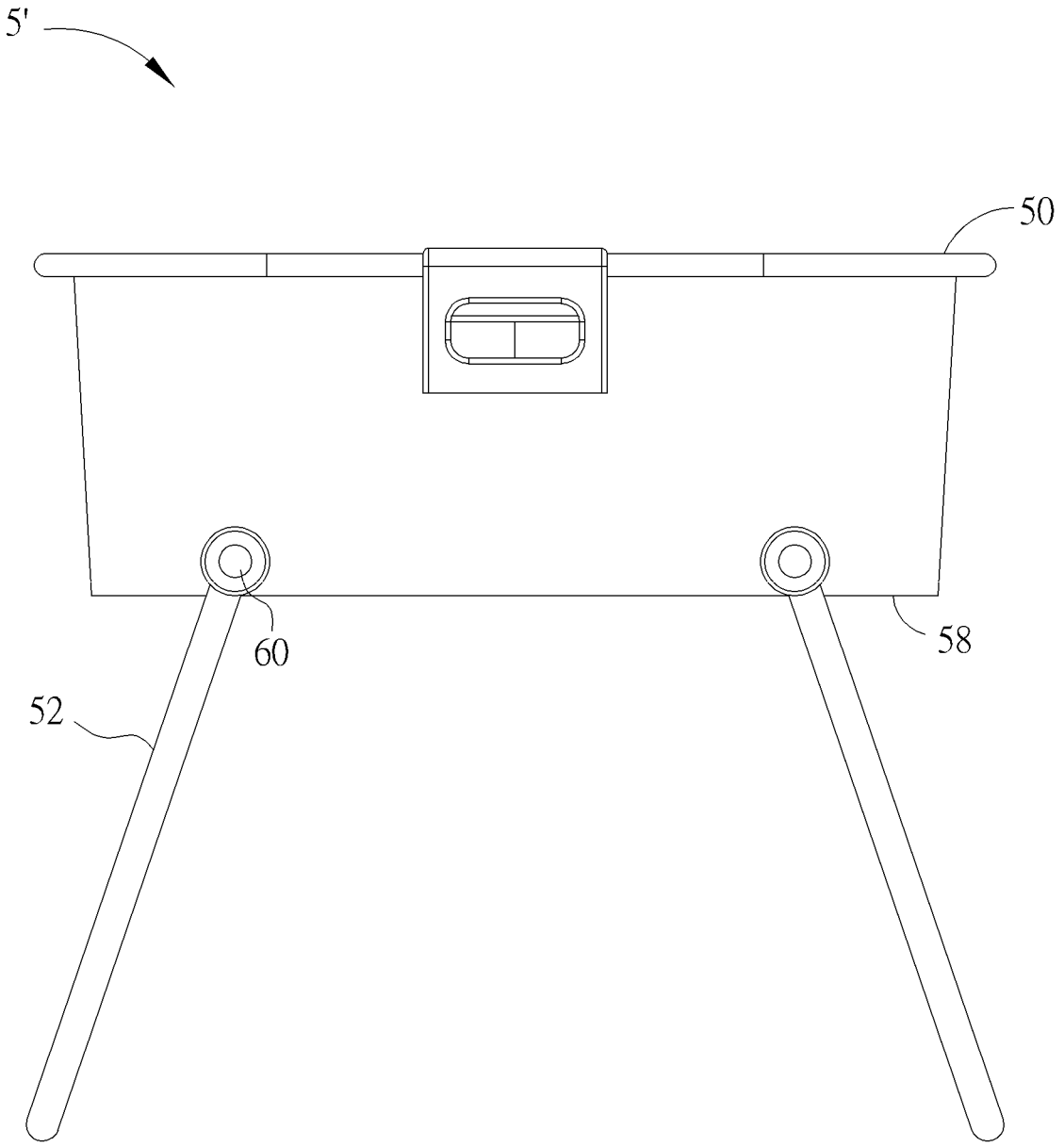
FIG. 17 is a side view illustrating the bassinet shown in FIG. 16 being adjusted to another height.
Figure 18:
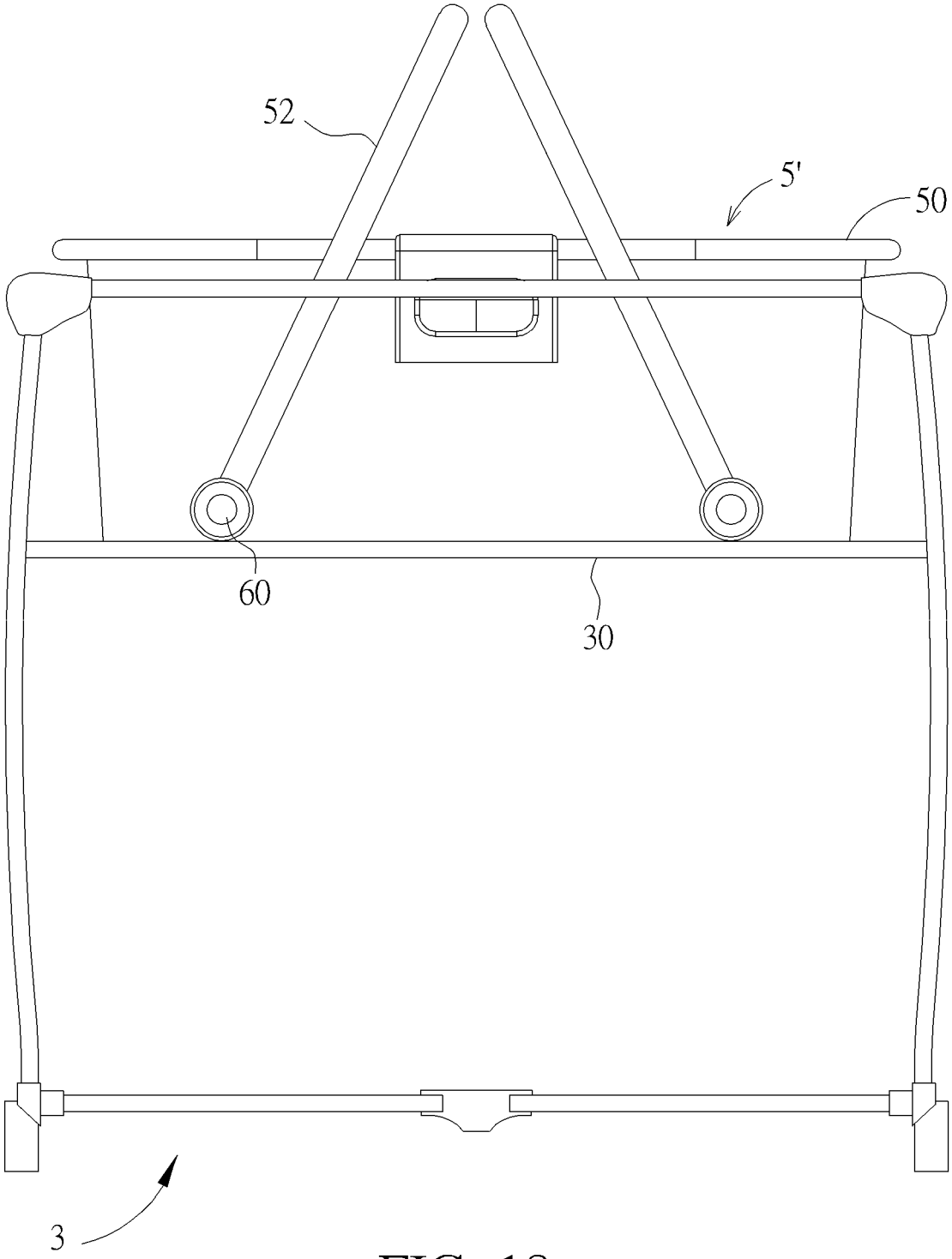
FIG. 18 is a side view illustrating the bassinet shown in FIG. 16 being placed in the play yard.

Referring to FIGS. 16 to 18, FIG. 16 is a side view illustrating a bassinet 5' according to another embodiment of the invention, FIG. 17 is a side view illustrating the bassinet 5' shown in FIG. 16 being adjusted to another height, and FIG. 18 is a side view illustrating the bassinet 5' shown in FIG. 16 being placed in the play yard 3.

The main difference between the bassinet 5' and the aforesaid bassinet 5 is that the bassinet 5' only comprises the first support member 52 without the second support member 54 and the link member 56 mentioned in the above. Furthermore, the pivot hub 60 is located on the perimeter of the sleeping surface 58. The first support member 52 is pivotally connected to the pivot hub 60, such that the first support member 52 can rotate between an upward position (as shown in FIG. 16) and a downward position (as shown in FIG. 17). The pivot hub 60 may have a locking mechanism (not shown) that allows the first support member 52 to rotate 180 degrees and locked at the upward position and the downward position.

As shown in FIG. 16, when the first support member 52 rotates to the upward position, the first support member 52 can be served as a handle for carrying the bassinet 5' and the height of the bassinet 5' can be shortened to be close to the ground. At this time, the bassinet 5' can function similar to a carry-cot. As shown in FIG. 17, when the first support member 52 rotates to the downward position, the first support member 52 can be served as a stand for supporting the bassinet 5' on a plane and the height of the bassinet 5' can be lengthened to achieve bedside height. Accordingly, the bassinet 5' of the invention can be adjusted to various heights for a given situation.

As shown in FIG. 18, the bassinet 5' in the carry-cot mode may be placed in the play yard 3. For example, the bassinet 5' may be placed on the elevated mattress 30 of the play yard 3. The bassinet 5' placed on the mattress 30 of the play yard 3 can provide a higher position of use, such that a caregiver can easily monitor a baby or child sleeping in the bassinet 5'. Since the bassinet 5' of the invention can be used alone and can also be used with the play yard 3, the bassinet 5' of the invention is more flexible in use than a conventional bassinet.

Figure 19:
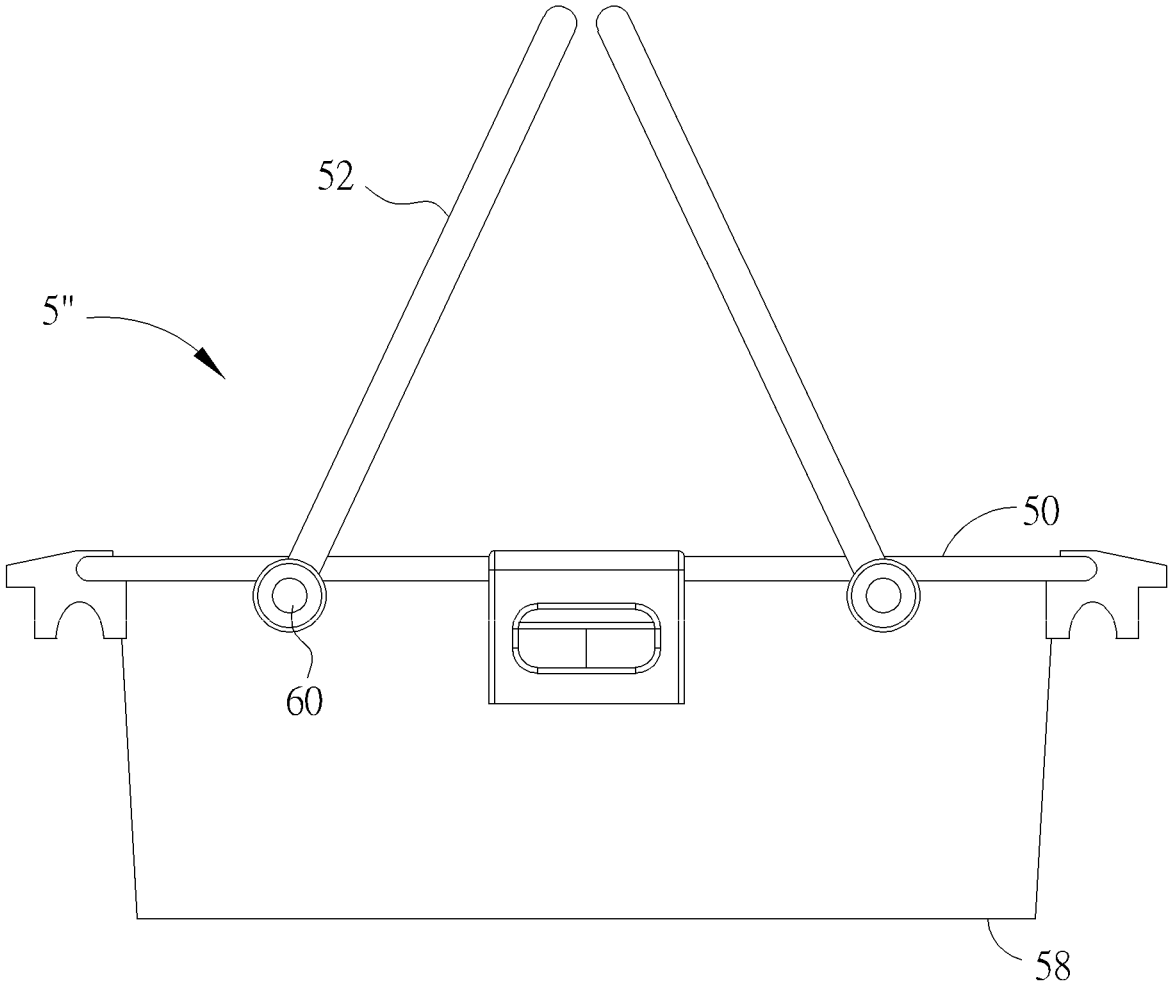
FIG. 19 is a side view illustrating a bassinet according to another embodiment of the invention.
Figure 20:
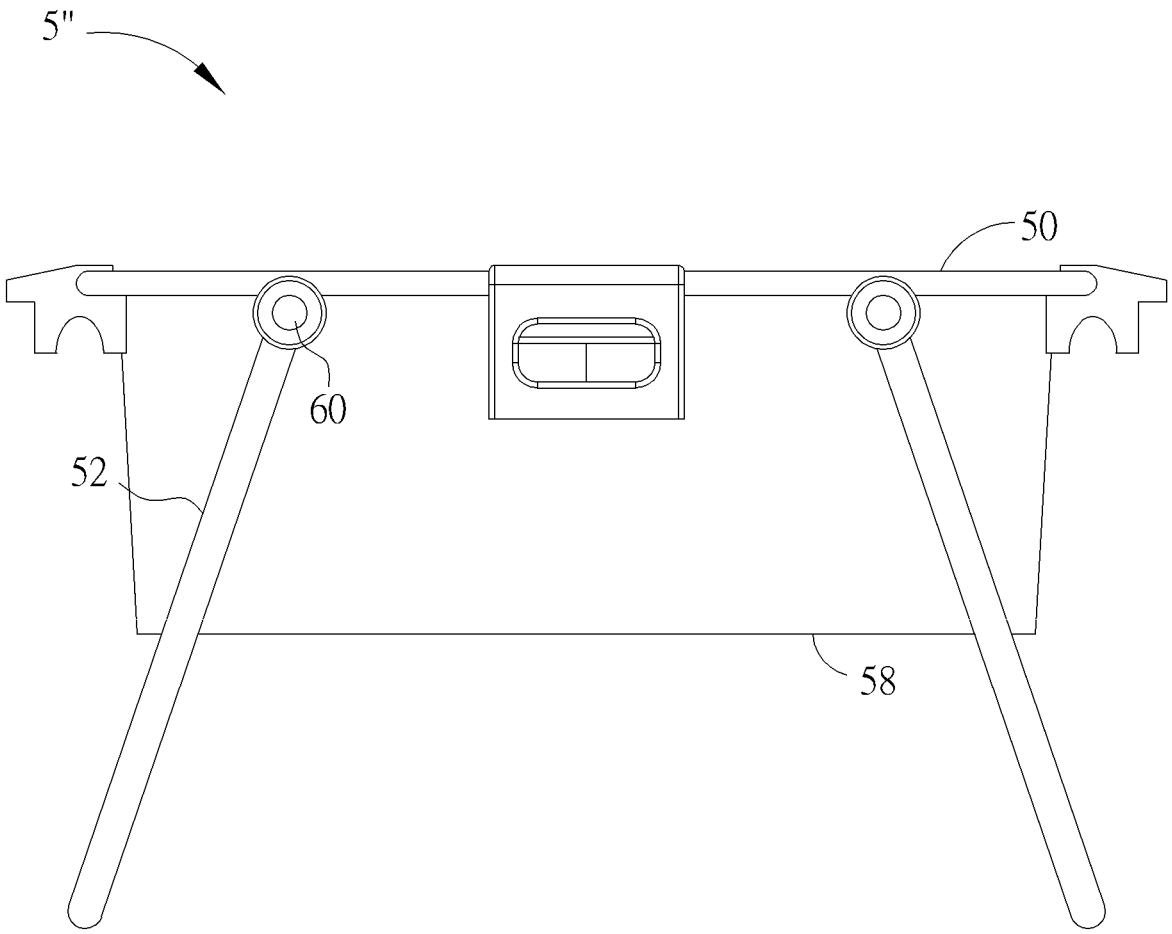
FIG. 20 is a side view illustrating the bassinet shown in FIG. 19 being adjusted to another height.
Figure 21:
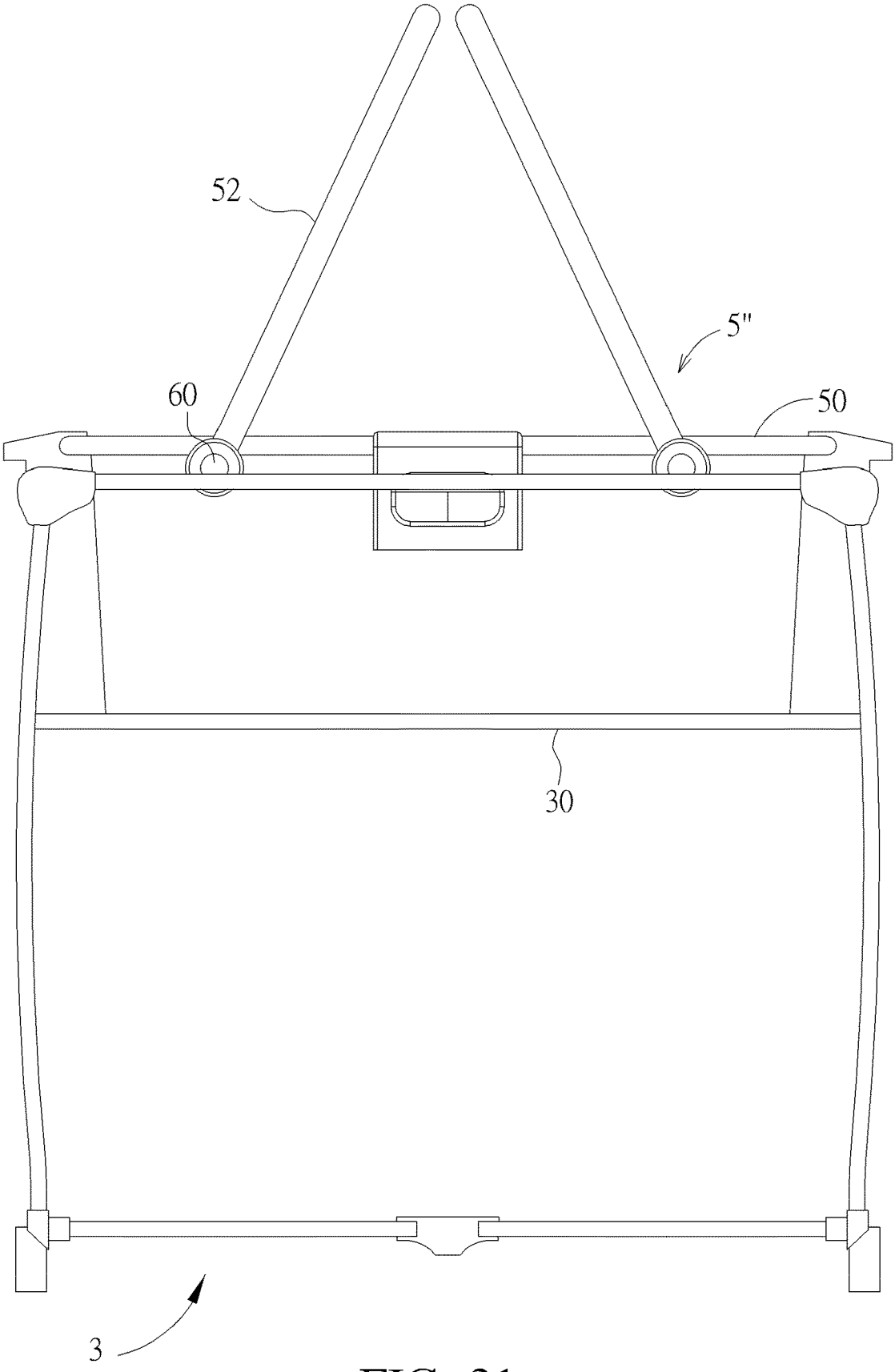
FIG. 21 is a side view illustrating the bassinet shown in FIG. 19 being placed in the play yard.

Referring to FIGS. 19 to 21, FIG. 19 is a side view illustrating a bassinet 5' according to another embodiment of the invention, FIG. 20 is a side view illustrating the bassinet 5" shown in FIG. 19 being adjusted to another height, and FIG. 21 is a side view illustrating the bassinet 5" shown in FIG. 19 being placed in the play yard 3.

The main difference between the bassinet 5" and the aforesaid bassinet 5' is that the pivot hub 60 of the bassinet 5" is located on the perimeter of the rail structure 50. The first support member 52 is pivotally connected to the pivot hub 60, such that the first support member 52 can rotate between an upward position (as shown in FIG. 19) and a downward position (as shown in FIG. 20). The pivot hub 60 may have a locking mechanism (not shown) that allows the first support member 52 to rotate 180 degrees and locked at the upward position and the downward position.

As shown in FIG. 19, when the first support member 52 rotates to the upward position, the first support member 52 can be served as a handle for carrying the bassinet 5" and the height of the bassinet 5" can be shortened to be close to the ground. At this time, the bassinet 5" can function similar to a carry-cot. As shown in FIG. 20, when the first support member 52 rotates to the downward position, the first support member 52 can be served as a stand for supporting the bassinet 5" on a plane and the height of the bassinet 5" can be lengthened to achieve bedside height. Accordingly, the bassinet 5' of the invention can be adjusted to various heights for a given situation.

As shown in FIG. 21, the bassinet 5" in the carry-cot mode may be placed in the play yard 3. For example, the bassinet 5" may be placed on the elevated mattress 30 of the play yard 3. The bassinet 5" placed on the mattress 30 of the play yard 3 can provide a higher position of use, such that a caregiver can easily monitor a baby or child sleeping in the bassinet 5". Since the bassinet 5" of the invention can be used alone and can also be used with the play yard 3, the bassinet 5" of the invention is more flexible in use than a conventional bassinet.

As mentioned in the above, in an embodiment, the invention may telescopically connect the first support member and the second support member together and utilize the latch mechanism to lock or unlock the first support member and the second support member, so as to adjust the height of the bassinet by sliding the first support member and the second support member with respect to each other. In another embodiment, the invention may pivotally connect the first support member to the pivot hub on the bassinet, so as to adjust the height of the bassinet by rotating the first support member. Accordingly, the bassinet of the invention can be adjusted to various heights for a given situation. For example, the height of the bassinet may be shortened to be close to the ground or be lengthened to achieve bedside height. Furthermore, the bassinet may be adjusted to a desired height and then placed in a play yard without requiring additional components. Since the bassinet of the invention can be used alone and can also be used with the play yard, the bassinet of the invention is more flexible in use than a conventional bassinet.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A bassinet comprising:

a rail structure;

a first support member connected to the rail structure, the first support member comprising a first slot;

a second support member telescopically connected to the first support member, the second support member comprising a plurality of second slots; and a latch mechanism configured to lock or unlock the first support member and the second support member, the latch mechanism comprising a housing, a latch member and an operating member, the housing being attached to a bottom of the first support member, the latch member passing through the first slot and engaging with one of the second slots to lock the first support member and the second support member, the operating member having a guiding groove, a connecting portion and a ring-shaped portion, the connecting portion connecting the guiding groove and the ring-shaped portion, the guiding groove being disposed in the housing, the connecting portion extending out of the housing, the ring-shaped portion being sleeved on the first support member and close to the handrail structure, the latch member being disposed in the housing and having a guiding portion disposed in the guiding groove;

wherein when the ring-shaped portion is operated to move, the guiding groove drives the guiding portion to move so that the latch member disengages from the second slot of the second support member to unlock the first support member and the second support member.

2. The bassinet of claim 1, wherein the first support member has a handle above the rail structure.

3. The bassinet of claim 1, wherein the first support member is in an inverted U-shape.

4. The bassinet of claim 1, wherein the latch mechanism comprises an elastic member abutting against the operating member; when the operating member is operated to move, the elastic member is compressed by the operating member; when the first slot is aligned with one of the second slots and the operating member is released, the elastic member forces the operating member to return the latch member into the second slot.

5. The bassinet of claim 1, wherein the guiding groove is inclined with respect to a direction of movement of the operating member.

6. The bassinet of claim 1, wherein the rail structure comprises a socket and the first support member is detachably connected to the socket.

7. The bassinet of claim 1, wherein the rail structure comprises a hanging member configured to hang the bassinet on a top frame of a play yard.

8. The bassinet of claim 1, wherein the bassinet is adapted to be placed in a play yard and a sleeping surface of the bassinet is flush with or higher than a top frame of the play yard.

* * * * *